US006854220B2

(12) United States Patent
Dueck et al.

(10) Patent No.: US 6,854,220 B2
(45) Date of Patent: Feb. 15, 2005

(54) RETAINING WALL SYSTEM

(75) Inventors: Vernon John Dueck, Coquitlam (CA); Richard Blair Crooks, Bellevue, WA (US)

(73) Assignee: Pacific Precast Products Ltd., Coquitlam (CA)

( * ) Notice: Subject to any disclaimer, the term of this patent is extended or adjusted under 35 U.S.C. 154(b) by 0 days.

(21) Appl. No.: 10/315,487

(22) Filed: Dec. 9, 2002

(65) Prior Publication Data

US 2003/0140585 A1 Jul. 31, 2003

Related U.S. Application Data

(63) Continuation of application No. 09/530,833, filed on Aug. 17, 2000, now Pat. No. 6,490,837.

(51) Int. Cl.[7] ..... E04B 1/00; E04C 1/00

(52) U.S. Cl. ..... 52/100; 52/98; 52/604; 52/603; 52/561; 52/606; 52/592.6; 405/286; D25/113; D25/115

(58) Field of Search ..... 52/592.6, 578, 52/606, 608, 405.1, 561, 603, 604, 612, 98, 100, 592.1; 405/286; D25/113, 115

(56) References Cited

U.S. PATENT DOCUMENTS

| | | | | | |
|---|---|---|---|---|---|
| 3,269,070 | A | * | 8/1966 | Stoy | 52/249 |
| 3,905,170 | A | * | 9/1975 | Huettemann | 52/591.1 |
| 4,964,761 | A | * | 10/1990 | Rossi | 405/286 |
| 6,082,057 | A | * | 7/2000 | Sievert | 52/100 |
| 6,223,493 | B1 | * | 5/2001 | Ruggeri | 52/592.6 |
| 6,490,837 | B1 | * | 12/2002 | Dueck et al. | 52/592.6 |
| 6,543,969 | B1 | * | 4/2003 | Adam | 405/284 |

* cited by examiner

*Primary Examiner*—Carl D. Friedman
*Assistant Examiner*—Chi Q Nguyen

(57) ABSTRACT

Retaining wall blocks and the walls made from such blocks are disclosed, wherein curved landscapes (i.e. curved profiles and sloping embankments) are easily accommodated without the use of mortar. As well, a modular system of blocks and their manufacture are disclosed wherein some blocks are used in vertical orientations and some in horizontal orientations.

2 Claims, 14 Drawing Sheets

351
351
315
300
320
300
400
401
300
300

315
351
320
351
315
320
300
300
300
300
300
300

VIEW E-E

VIEW D-D

RETAINING WALL SYSTEM

This is a continuation of U.S. application Ser. No. 09/530,833, filed Aug. 17, 2000 U.S. Pat. No. 6,490,837, the entire disclosure of which is incorporated herein by reference.

FIELD OF INVENTION

This invention relates to mortarless wall constructions and blocks therefor, particularly suitable to act as retaining walls to secure embankments and terraces.

BACKGROUND OF INVENTION

To secure earth embankments against sliding and slumping, the retaining wall industry knows various interlocking and mortarless systems.

Interlock mechanisms which involve pins and sockets, require close supervision by the labourers and the omission of even one pin may compromise the structural integrity of a course of blocks and thereby the entire wall. Also, these pin and sockets mechanisms do not permit significant lateral movement of blocks for working around curves in the embankment.

For large embankments (such as those found near highways), the blocks must be large. Known blocks are solid (i.e. no through core), typically measure in the order of 5'×2½'×2½' and weigh in the order of 5000 lbs. They are interlocked by large right-angled lugs and corresponding sockets, which severely restricts the ability to create non-90° concave or convex curve wall portions in response to the embankment profile.

For the purposes of this invention, the following definitions will be employed. "Batter" is the apparent inclination, from vertical, of the wall face. A "half-bond" is the relationship or pattern created by stacking units so that the vertical joints are offset one half unit from the course below. For orientation, "convex", "concave", "left", "right" are determined from the point of view of a viewer facing the front face of the block or wall portion. "Lateral" means along the longitudinal axis of the block or course of blocks, parallel to the front face. "Filler" is free draining granular material like crushed, angular rock pieces of perhaps ½" or ¾" size.

SUMMARY OF INVENTION

There is provided a block comprising a front wall; a rear wall; first side wall; second side wall opposed to said first side wall; an upper block planar surface; a lower block planar surface; wherein said first side wall and said second side wall extend from said front wall to said rear wall to define a central through core extending through the block from said upper block surface to said lower block surface, said core having a front upper rim and a first front corner at the plane of said upper block surface, proximate intersection of said first side wall and said front wall; a first lug which extends downwardly from said lower block surface adjacent said first side wall, and has (i) a flat side portion flush with said first side wall (ii) a front portion which joins said first lug side surface at an angle of 90° or less.

DETAILED DESCRIPTION OF THE INVENTION

Figure 1:
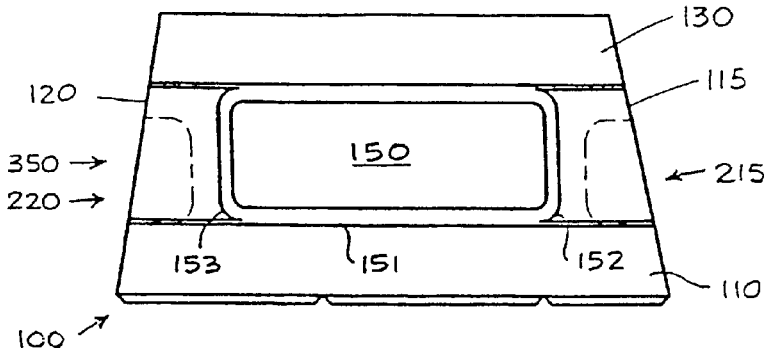
FIG. 1 is a top view of a block according to the invention

As shown in FIGS. 1–4, block 100 has front wall 110; rear wall 130 spaced rearwardly and parallel to front wall 110; first side wall 115; second side wall 120; in a bilaterally symmetrical trapezoidal configuration in top view. The walls define a central through core 150. There is an upper block planar surface 140 and lower block planar surface 141. Associated with first side wall 115 and second side wall 120 are respectively lugs 215 and 220 depending integrally and downwardly from lower block surface 141.

Figure 9:
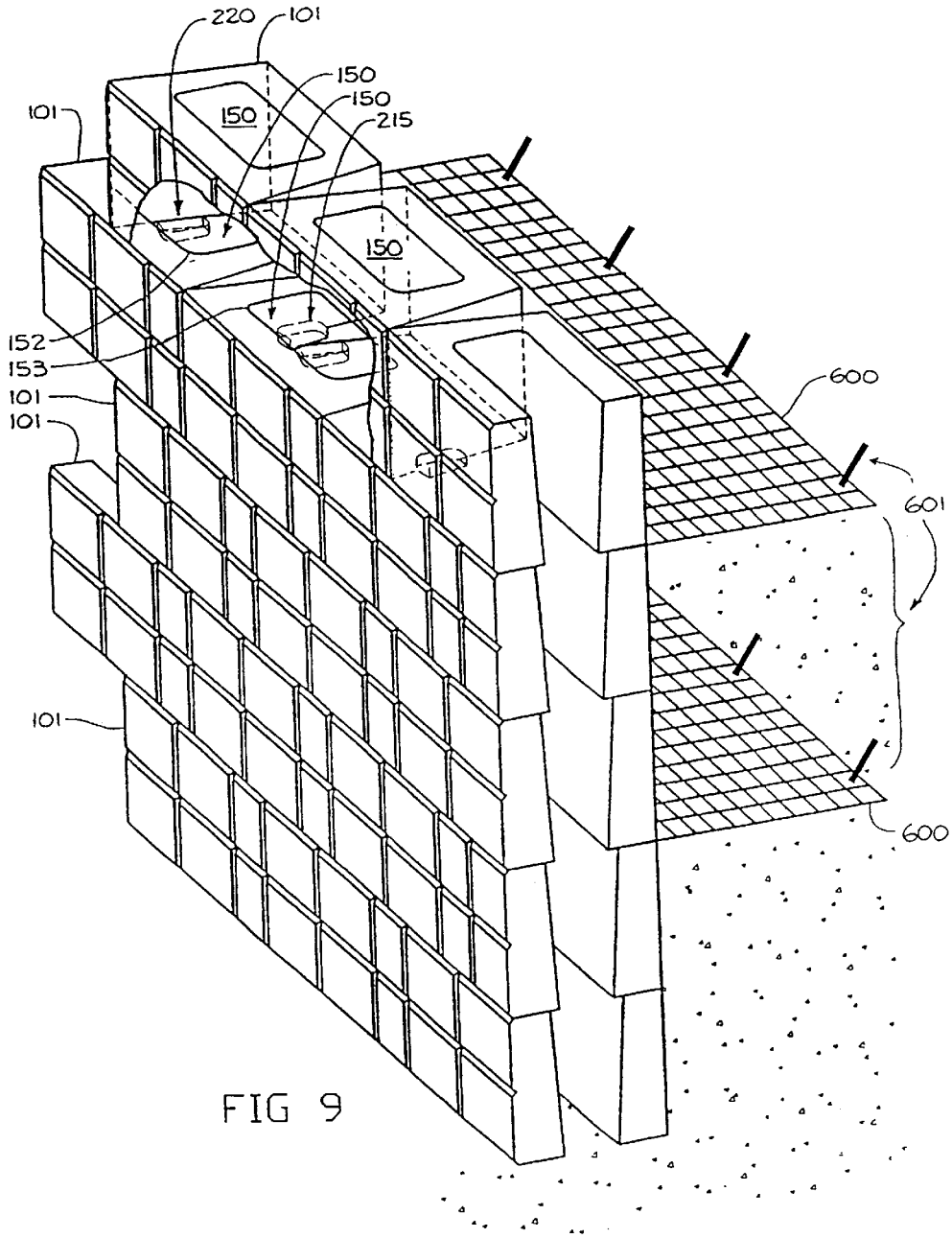
FIG. 9 is a perspective view of a wall portion constructed from a variation of the blocks of FIG. 8, secured by geogrid

In a variation, block 101 is identical to block 100 but, as shown in FIG. 9, has no channel equivalent to channel 350. In that variation, lug 215 is disposed within core 150 of the underjacent block and the most forward rim of front arcuate portion 217 of lug 215 may abut core corner 153 in some applications (not shown). Core 150 of block 101 is of sufficient lateral length that lug 215 or lug 220 of a block 100 of a superjacent course may be shifted laterally left or right (to achieve half-bond or to deviate from half-bond) without changing the resulting batter of the straight wall. Explanations about block 100 are equally applicable to block 101 (except where the context indicates otherwise) and will not be repeated for economy of description.

Through core 150 extends downwardly to lower block surface 141 and is shown to taper inwardly although this is optional to facilitate its manufacture. Core 150 has a front upper rim 151 and rear upper rim 154, both parallel to front wall 110. Core 150 has first front corner 152 and second front corner 153, which are arcuately profiled. Through core 150 accommodates filler or vertical reinforcing rod 701 embedded in poured concrete (as will be explained below).

Figure 2:
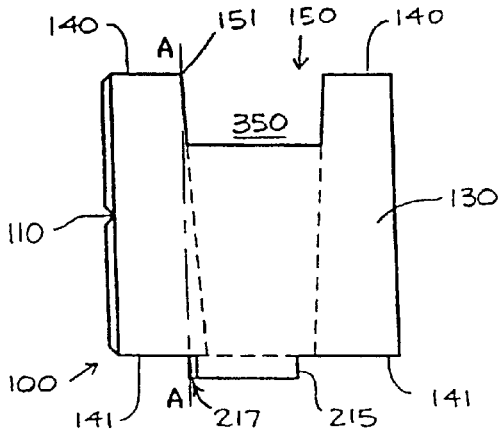
FIG. 2 is a side view of the block of FIG. 1
Figure 4:
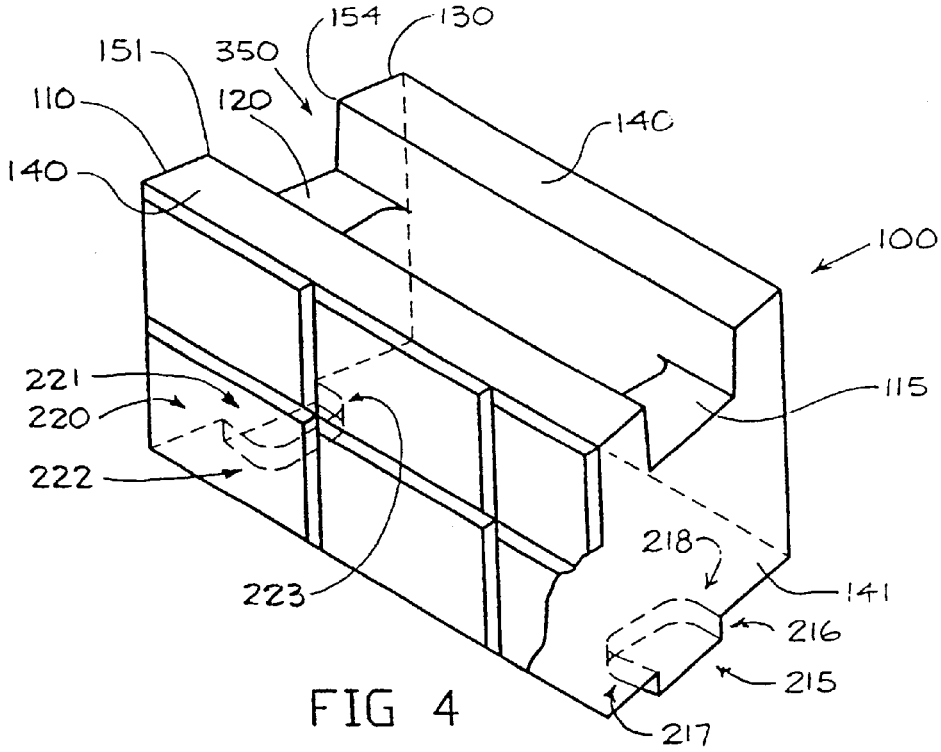
FIG. 4 is a perspective view of the block of FIG. 1
Figure 8:
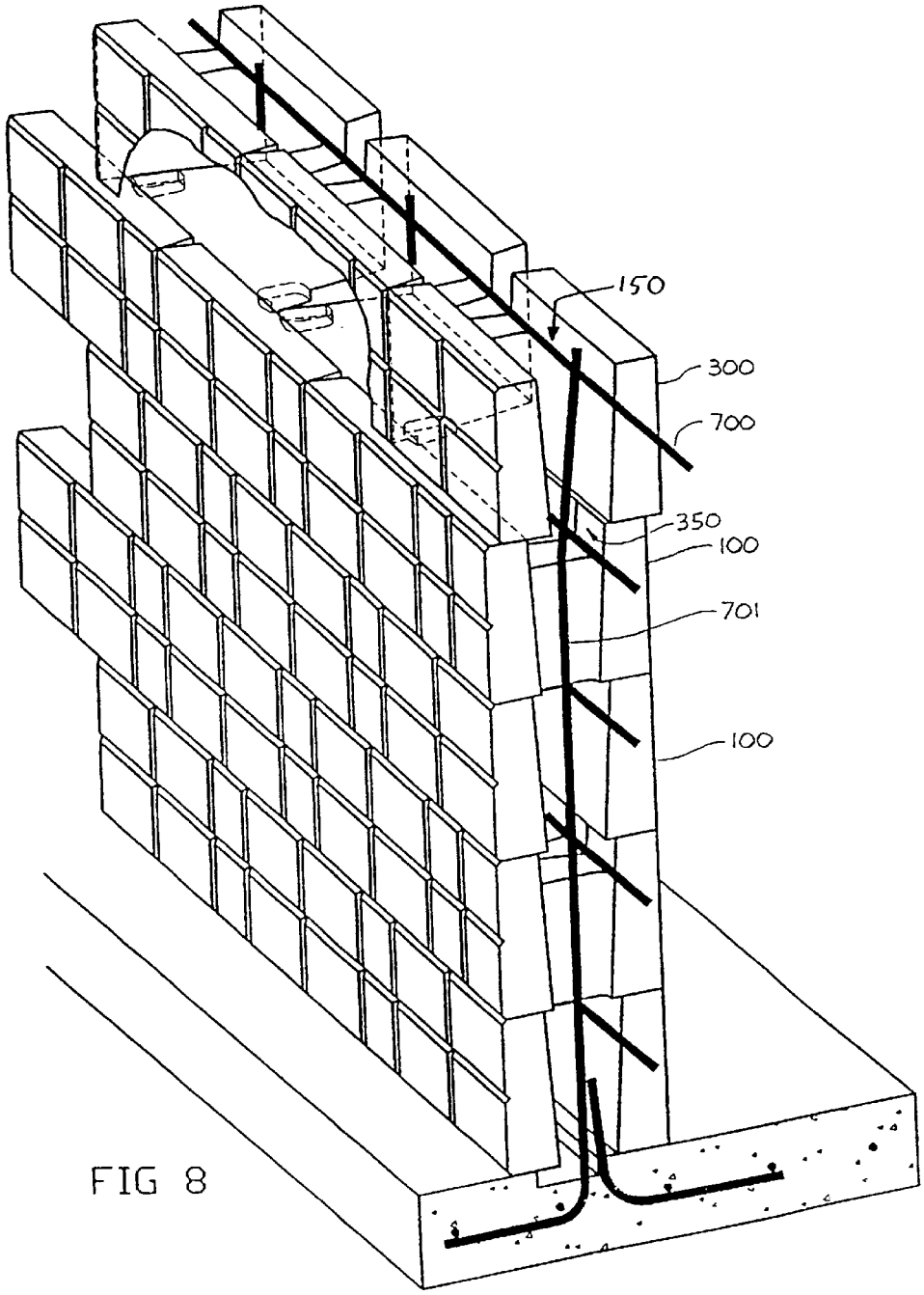
FIG. 8 is a perspective view of a wall portion constructed from the blocks of FIGS. 6 and 7, secured by geogrid

As best shown in FIGS. 2, 4 and 8, block 100 has a horizontal channel 350 which extends vertically downwardly from upper block surface 140 (coinciding with core front rim 151 and core rear upper rim 154), horizontally between first side wall 115 and second side wall 120 and intermediately of front wall 110 and rear wall 120. Channel 350 is not necessary for the construction of a wall but is useful to accommodate reinforcing rods 700 extending from block to block along a course of blocks (as will be explained below in conjunction with FIG. 8) or anchor bars 702 (as will be explained in below conjunction with FIG. 10*b*).

Figure 5:
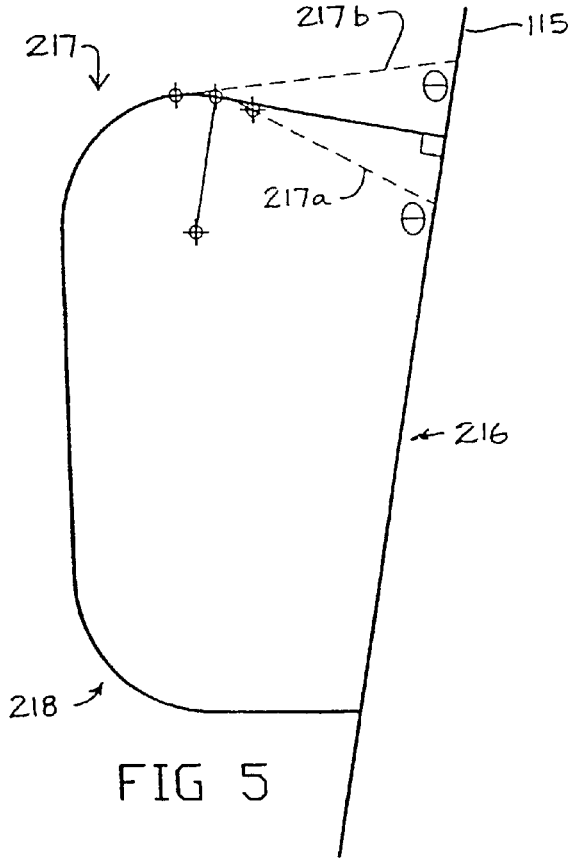
FIG. 5 is a bottom view of a lug according to the invention

Lugs 215 and 220 provide the engagement means between blocks 100 of one course with blocks 100 of the underjacent course. As best shown in FIG. 5, lug 215 is profiled in an approximate cam shape, with a side portion 216 (which is flush with outer face of block side wall 115), a front arcuate portion 217 and a rear arcuate portion 218.

As best shown in FIG. 5, front arcuate portion 217 of lug 215 meets side portion 216 of lug 215 at 90°. Alternatively, front arcuate portion 217*a* may meet side portion 216 at an angle È greater than 90° to facilitate forming a more convex wall portions. Alternatively, front arcuate portion 217*b* may meet side portion 216 at an angle È less than 90° to facilitate forming a more concave wall portion. È around 90° is a reasonable compromise to achieve turnability and mass (for shear strength).

Figure 3:
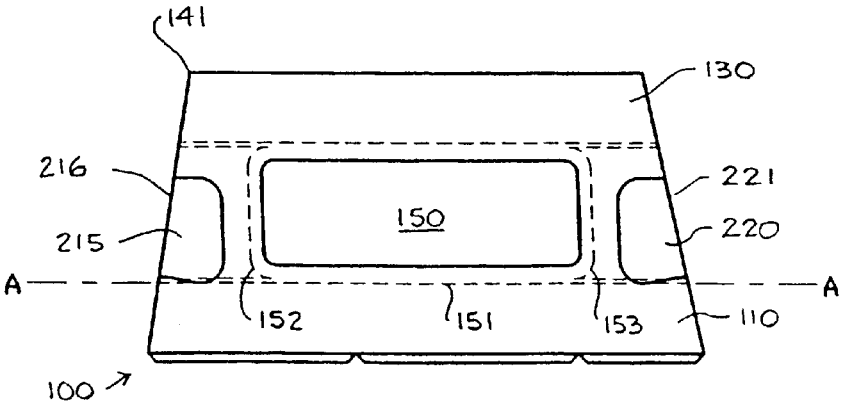
FIG. 3 is a bottom view of the block of FIG. 1

A part of the most forward rim of front arcuate portion 217 of lug 215 approximates a quarter circle. Front arcuate portion 217 is profiled, in part, to be complementary to core corner 153 of a block 100 of an underjacent course (as best shown in FIGS. 8 and 9 and as will be explained below), and if not complementary, front portion 217 must have at least a forward arcuate portion. The most forward rim of arcuate portion 217 is positioned to lie in the same vertical plane A—A as the front upper rim 151 of core 150 lies, as best shown in FIGS. 2 and 3. Lug 220 is identical to lug 215 in all material respects, except that it is disposed as a mirror image of lug 215 on the opposite side of block 100 (i.e. proximate side wall 120). The principles involving lug 215 will be described on most occasions below, and, although applicable also to lug 220, will not be repeated for economy of description.

Core corner 153 approximates a quarter circle with a radius approximately equal to the approximate radius of arcuate portion 217. The exact shape of core corner 153 is not critical and a core with an angular corner is possible. With the presence of channel 350, only front upper rim 151 of core 150 will contact front arcuate portion 217 and there is no contact between core corner 153 and lug 215, so corner might be a 90° one. Even with block 101, core corner 153 need not be arcuately complementary as long as the respective shapes of front arcuate portion 217 and core corner 153 permit lug 215 to turn easily relative to core front rim 151. At a minimum, lug front portions 217 must be arcuate so it can abut front upper rim 151 of core 150 of the underjacent block 100 and be turnable in a wide range of angles.

In this way, block 100 of an upper course creates two pivoting axes relative to the two blocks 100 of the underjacent course. Specifically, the first pivoting axis is at the contact point between lug front portion 217 of lug 215 and front upper rim 151 of core 150 of the left underlying block 100 and the second pivoting axis is at the contact point between lug front portion 222 and front upper rim 151 of core 150 of the right underlying block 100. This is shown in FIG. 9 for block 101 and in FIGS. 8 and 13 for block 300 (a variation of block 100 which will be described below). These two pivoting axes are advantageous for creating convex or concave wall portions.

Rear portion 218 of lug 215 may be provided with an arcuate corner approximating a quarter-circle, as shown in FIG. 5. The exact shape circumscribed by rear portion 218 is subject to design considerations.

To facilitate the manufacture of the blocks and lugs, rear portion 218 should extend from front portion 217 transversely to front wall 110, but other directions are possible.

The dimensions of lug 215 affect the shear strength and the turnability of lug 215 within the core of a lower block (as will be explained below). There must be enough mass to provide structural integrity and shear strength to lug 215. The advantage of increasing the mass is to increase the shear strength of lug 215 in the forward-to-rear direction. This advantage may be offset, in some applications, because the increased mass may make lug 215 less turnable relative to lower blocks. In particular, if the first pivoting axis (i.e. the contact point of lug 215 and front rim 151) is near side wall 120 of the lower block 100, and a concave curved wall is desired, then the arcuate rear portion 218 of lug 215 will provide more turnability towards side wall 120 than a 90° corner rear portion 218 (not shown). In other words, an arcuate rear portion 218 will permit a more concave curve wall portion if desired.

Because in block 100, the most forward rim of front arcuate portion 217 (and similarly, the most forward rim of front arcuate portion 222) are disposed in the same vertical plane A—A as front upper rim 151 of core 150 is, then the wall resulting from laying courses of such blocks 100, is a vertical wall, as shown in FIG. 8.

Figure 13:
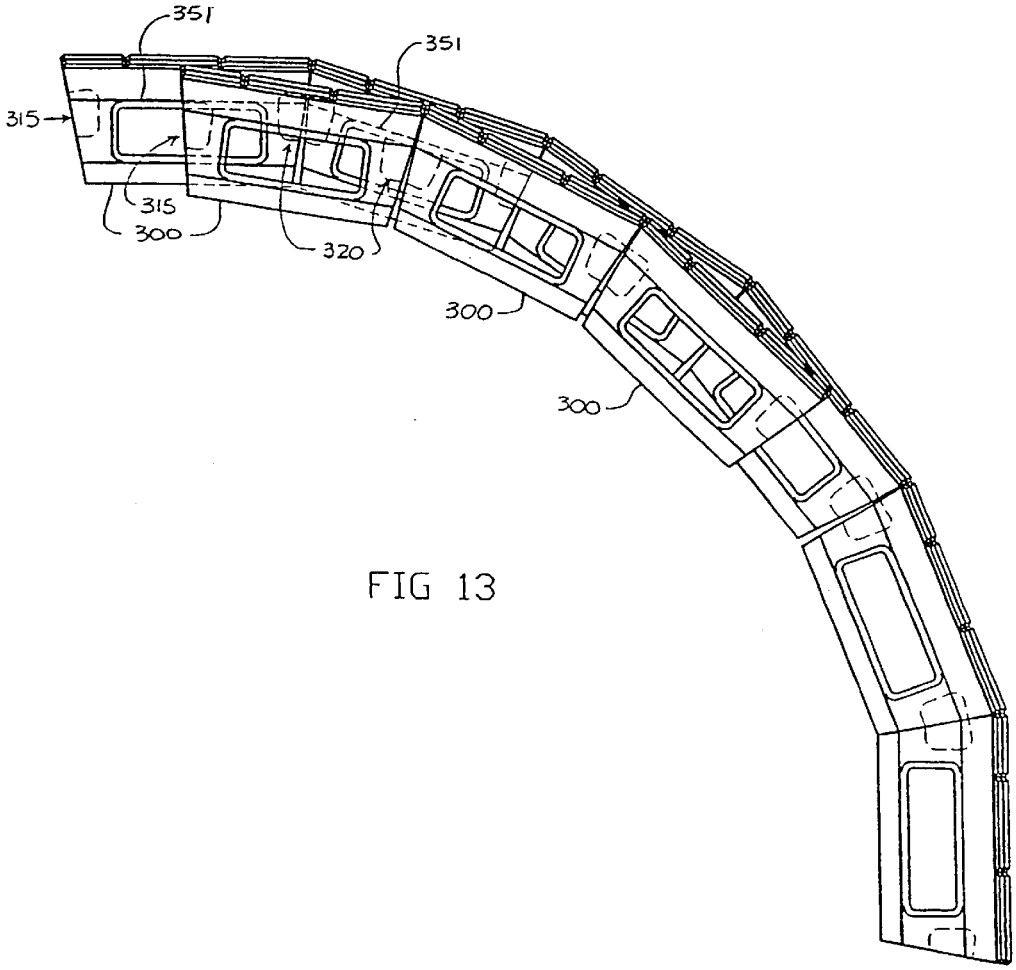
FIG. 13 is a top view of several courses of a convex wall portion constructed from the blocks of FIG. 6
Figures 14, 15:
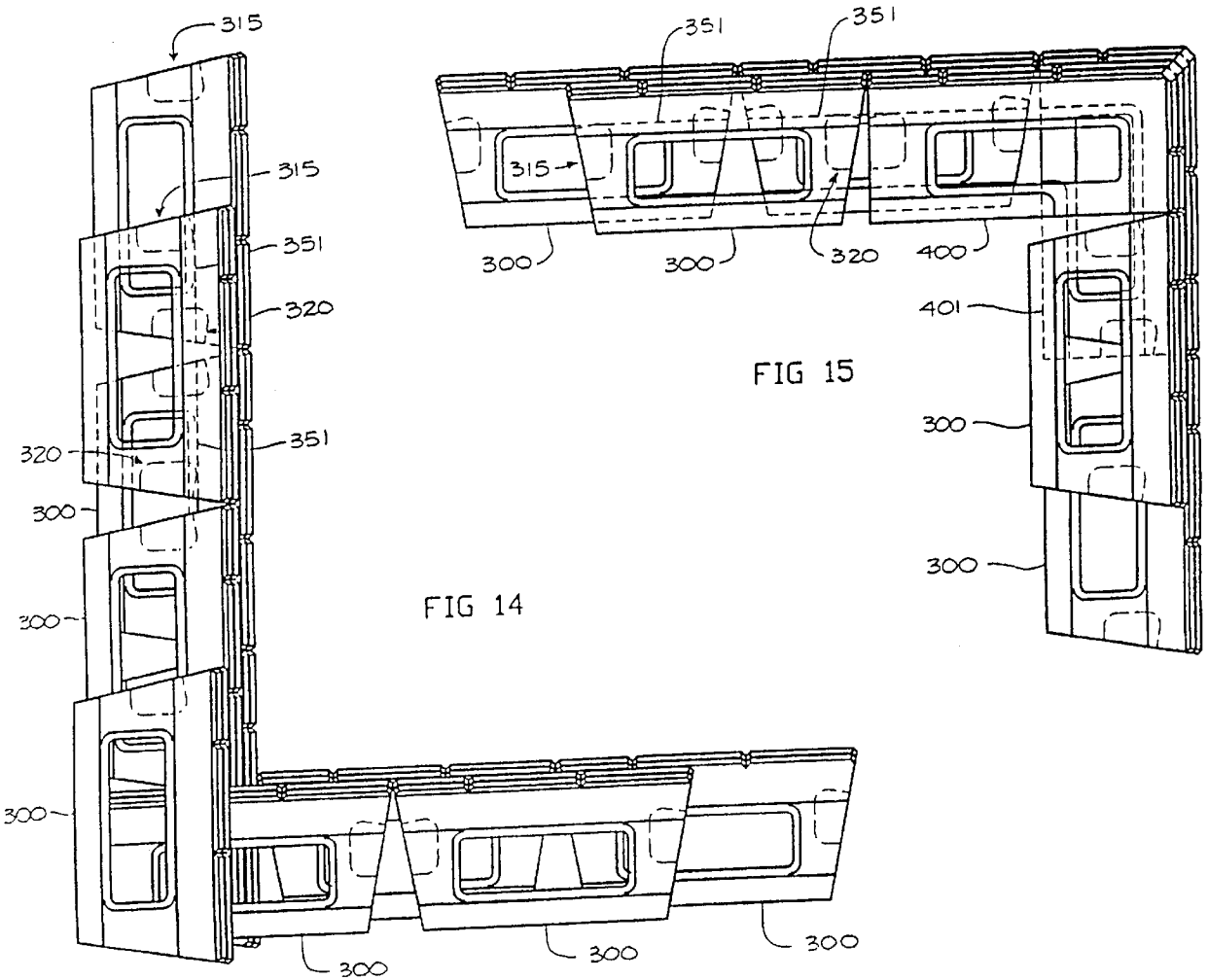
FIG. 14 is a top view of several courses of concave corner of a wall
FIG. 15 is a top view of several courses of convex corner of a wall

The trapezoidal shape of block 100 facilitates the formation of a convex wall portion, if desired, as shown in FIG. 13. But the formation of a straight wall portion or concave wall portion (as shown in FIGS. 8, 9 and 14) is in no way hampered by the trapezoidal shape of block 100.

As stated above, known blocks for the application to large embankments are solid (i.e. do not have a through core). One advantage of the blocks of this invention is the provision of a through core 150 to reduce the weight of block 100 and thereby create economic efficiencies in the transport of blocks 100 to the installation site. With a through core like 150, it is possible to achieve a weight reduction from a solid block of similar dimensions, in the order of one third. At the installation site itself, cores and channels are filled with filler or rods 700 and 701 embedded in poured concrete, as applicable. This creates a good vertical interlock bond (i.e. between superjacent courses of blocks and good tension with the geogrid, discussed below) to increase shear strength which is not available with courses of blocks without through cores.

Automatic Offset Block

Figure 6:
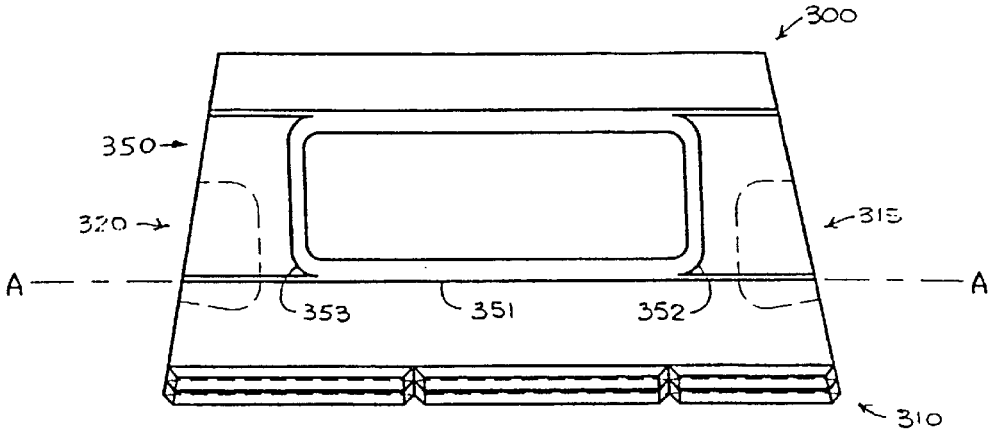
FIG. 6 is a top view of another block according to the invention
Figure 7:
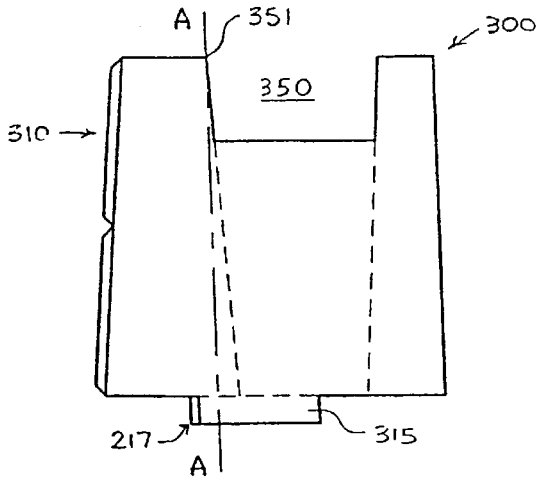
FIG. 7 is a side view of the block of FIG. 6

Block 300 (as shown in FIGS. 6 and 7) is used to create a wall portion with a batter. Block 300 is a variation of block 100 which is identical thereto in all material respects except for the relative disposition of the lugs relative to the core. Specifically, block 300 has two lugs 315 and 320 which are identical to lugs 215 and 220 of block 100, except that they are offset slightly forward of the vertical plane A—A defined by front upper rim 351 of core 150. The offset forward determines the degree of batter of the resulting wall portion. As shown in FIG. 8, the upper course of blocks 300 is offset from the underjacent course of blocks 100 by the amount of offset that the lugs of blocks 300 are offset forward of plane A—A defined by front upper rim 351 of core 150 of the underjacent course of blocks 100. Specifically, the batter of wall portions involving blocks 300 is defined by the ratio of the extent that front arcuate portion of lug 315 is forward of the vertical plane, to the height of block 300.

For a pleasing appearance, front wall 310 of block 300 is tapered so that the resulting battered wall portion of several courses of blocks 300 may have a flush, tapered appearance.

L-Shaped Block

Block 400 (shown in FIG. 11) is another shape of block suitable for a corner or end block of a wall portion. Block 400 has an L-shaped channel 450, which is similar to channel 350 of block 100, in that it extends from block upper surface from first side wall 425 towards second wall 420 (opposite first side wall 425), intermediate of rear wall 430 and front wall 410, but then it turns towards and terminates at rear wall 430.

Channel 450 accommodates a horizontal reinforcing rod 700 which is appropriately bent to navigate the turn in channel 450. There is a through core 445 identical to through core 150 of block 100, to accommodate filler or a vertical reinforcing rod 701 embedded in poured concrete (not shown). Depending integrally and downwardly from first side wall 410 is a lug 415, profiled and disposed similarly to lug 215 of block 100, and for economy of description, lug 415 will not be further described. The face of second side wall 420 may be contoured to have an attractive face, as shown.

Figure 11:
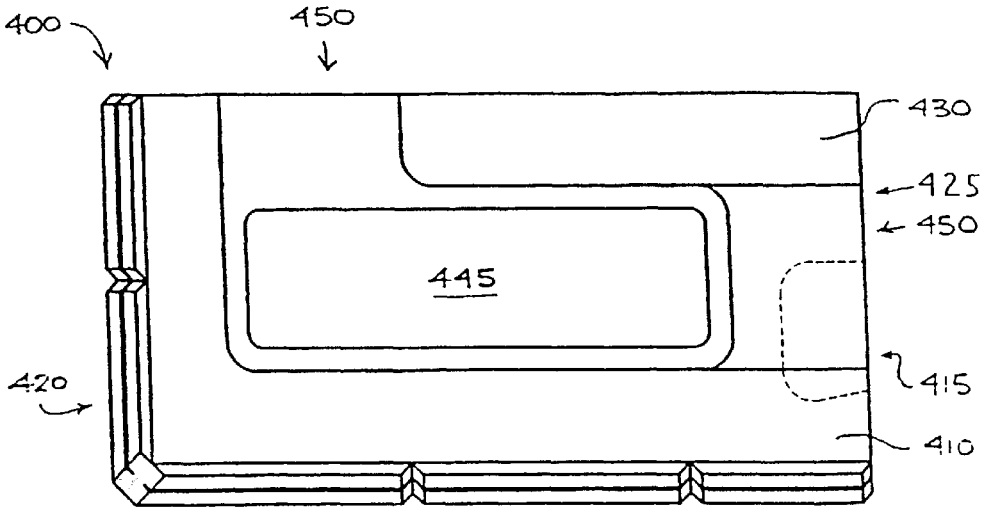
FIG. 11 is a top view of another block according to the invention

Shown in FIG. 11 is the offset version (i.e. lug 415 is offset slightly forward of the front rim of channel 450) but a non-offset version is possible by aligning lug 415 with the front rim of channel 450.

Block 401 is identical to block 400 in all respects except that the front and rear walls are reversed and the turn in the channel is corresponding reversed, and is shown in FIG. 15 (in dotted line for clarity). The use of block 400 and block 401 will be explained in conjunction below with the creation of corner wall portions in FIG. 15.

End Block

Square block 500 (shown in FIG. 12) is another block which is suitable for employment as a corner or end block. Block 500 is approximately half the length of block 100. Depending integrally and downwardly from first side wall 510 is lug 515, profiled and disposed similarly to lug 215 of block 100, and for economy of description, the description will not be repeated. Opposite first side wall 510 is second side wall 520, which has no lug depending therefrom. The outer faces of second side wall 520, as well as of front and rear walls, may be may be contoured to have an attractive face, as shown for second side wall 520.

Block 500 has a through core 545 identical to through core 150 of block 100, to accommodate filler or a vertical reinforcing rod 701 embedded in poured concrete (not shown). Block 500 has a blind channel 550, which is similar to channel 350 of block 100, in that it extends vertically from block upper surface and extends horizontally, intermediate the rear wall and the front wall, from first side wall 510 towards second side wall 520 (opposite first side wall 510). However, after extending over core 545 (to permit an unobstructed through core 545), channel 550 terminates before reaching second side wall 520.

Figure 12:
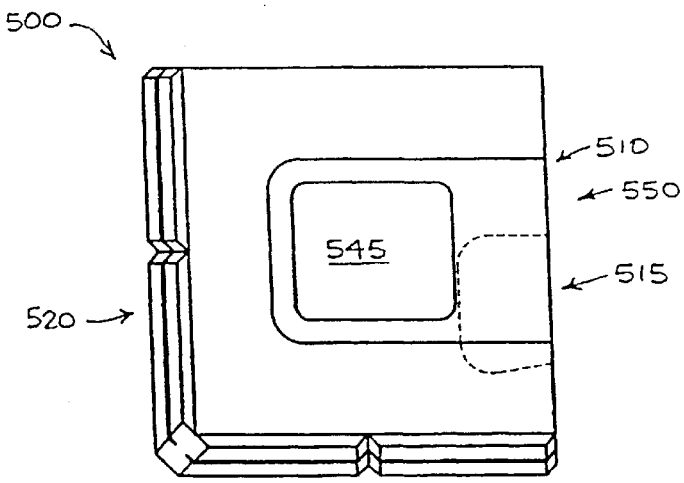
FIG. 12 is a top view of another block according to the invention

Block 500 shown in FIG. 12 is the offset version (i.e. lug 515 is offset slightly forward of the front rim of channel 550) but a non-offset version is possible by aligning lug 415 with the front rim of channel 550.

To make a wall with blocks 100, 300, 400 and 500, it is advantageous to render the blocks modular by having their lugs offset or aligned with their respective front rims of channels 350, 350, 450, 550, in a uniform way.

Constructing a Wall For a straight wall portion, blocks 100 or blocks 300 may be laid side-by-side in courses and the relationship between courses is a half bond or thereabouts (as shown in FIG. 8). Corner or end blocks 400 and blocks 500 are employed as desired.

The orientation of the blocks where the lugs face downwardly toward the ground ("downward orientation") is preferred over the reverse orientation where the blocks are laid with their lugs facing upwardly ("upward orientation"). In the downward orientation, the pivoting axes of a block of an upper course relative to the two associated blocks of the underjacent course, are positioned towards the front wall of the blocks. In the upward orientation, the pivoting axes of a block of a lower course relative to the two associated blocks of the superjacent course, are positioned towards the rear wall of the blocks. Because lugs 215 and 220 of blocks 100 are farther apart in the downward orientation than in the upward orientation, there is possible more lateral shifting from half-bond. Explained another way, in the upward orientation, lugs 215 and 220 are more proximate the respective associated side walls of the two superjacent blocks 100 and hence lower block 100 in upward orientation is more limited in its lateral freedom. As well as lateral freedom, when a curved wall portion is desired, the upward orientation is more limited than the downward orientation. Additionally, the batter in curved portions of the wall will change in an accelerated way with blocks in the upward orientation compared to blocks in downward orientation, and this may be undesirable depending on the application.

Both the upward orientation and the downward orientation are possible, and the choice is one of design. Obviously, to lay the bottom course of blocks in the downward orientation, their lugs may be removed with a hammer or saw, or they may be keyed into a foundation by conventional methods.

The 90° concave corner using blocks 300, shown in FIG. 14, is created by the transverse meeting of the two wall portions which, in alternating courses, overlap each other at the corner. Specifically, end block 300 of one wall portion is laid past the end block 300 of the other wall portion of the same course, and in the next course, the arrangement is reversed. The lug of a block which is laid past, must be removed. The cores are filled with filler and provide vertical bonding between courses. Because blocks 300 create automatically a batter, each block 300 should be placed laterally towards the corner an appropriate amount from half-bond, to compensate for the fact that the portions of the two wall portions are receding away from each other as they rise because of their respective batters. An appropriate lateral displacement is the amount that lugs 315 and 320 are forward of the plane A—A defined by front core rim 351.

The offset dynamic for a non-90° concave curve wall portion using blocks 300 (not shown), is similar to that of the 90° concave corner using blocks 300. The radius of the curve of each course increases as the wall rises. In other words, there is an increasingly positive batter. If it is desired to create a more vertical wall, a fraction of the front of front portion of lugs 315 and 320 may be shaved (i.e to approximate lugs 215 and 220 of block 100) and lateral offsets towards the center of the curve may be employed.

For a non-90° concave curve wall portion using blocks 100, as the courses of the curve rise, the radius of curvature decreases, i.e., a batter slanted inwardly is naturally created by the fact that blocks 100 are pivoting at two points behind front of the front wall of the block below.

The arrangement for a 90° convex corner using blocks 300, shown in FIG. 15, is similar to that for the 90° concave corner using blocks 300, with a few differences. First, corner block 400 and corner block 401 (shown in dotted lines for clarity) are necessary, which alternate in adjacent courses to overlap each other to form the corner. Secondly, each block 300 should be placed laterally away from the corner an appropriate amount off center, to compensate for the fact that the portions of the wall to the left and right of the corner are moving towards each other because of their respective batters.

A non-90° convex curve wall portion using blocks 300 is shown in FIG. 13. The radius of the curve of each course decreases as the wall rises. In other words, there is an increasingly positive batter. If it is desired to create a more vertical wall, a fraction of the front of front arcuate portions of lugs 315 and 320 may be shaved (i.e to approximate lugs 215 and 220 of block 100) to reduce the offset.

For a non-90° convex curve wall portion using blocks 100, as the courses of the curve rise, the radius of curvature increases, i.e., a batter slanted outwardly is naturally created by the fact that blocks 100 are pivoting at two points in front of the front wall of the block below.

Corners or turns should be built from the corner or center of the curve, outwardly, i.e. from the central block and proceeding left and right. For blocks with an automatic offset, each block will gain in a concave curve, and fall behind in a convex curve, relative to the blocks below.

Geosynthetic Sheet Anchor

After laying several courses of blocks, back filling with soil and gravel, and compacting, a geosynthetic sheet is secured to the then upper course of blocks and spread over the backfill, as will be explained below. The process is repeated until a wall of the desired height is obtained.

Figure 10A:
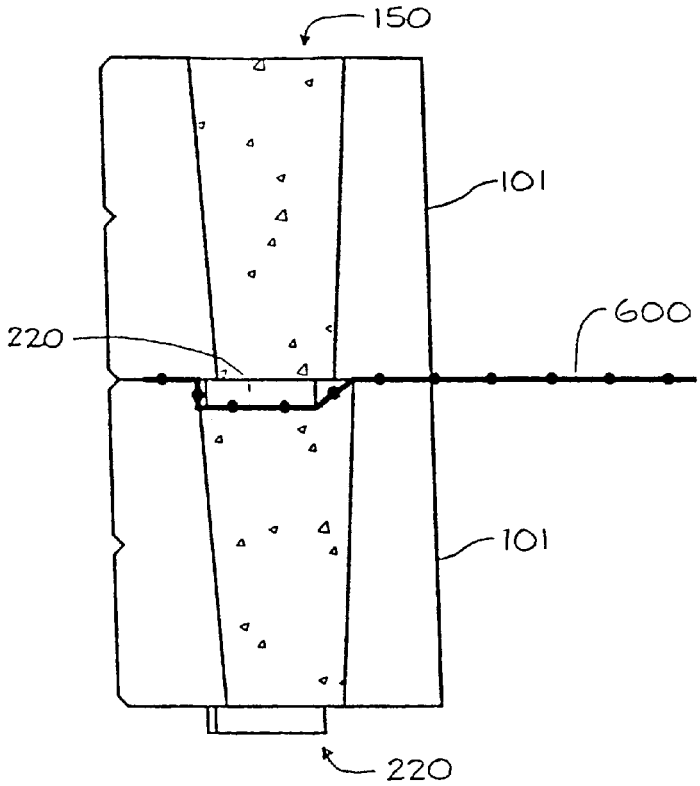
FIG. 10*a* is a side view of the wall portion and securing of the geogrid of FIG. 9
Figure 10B:
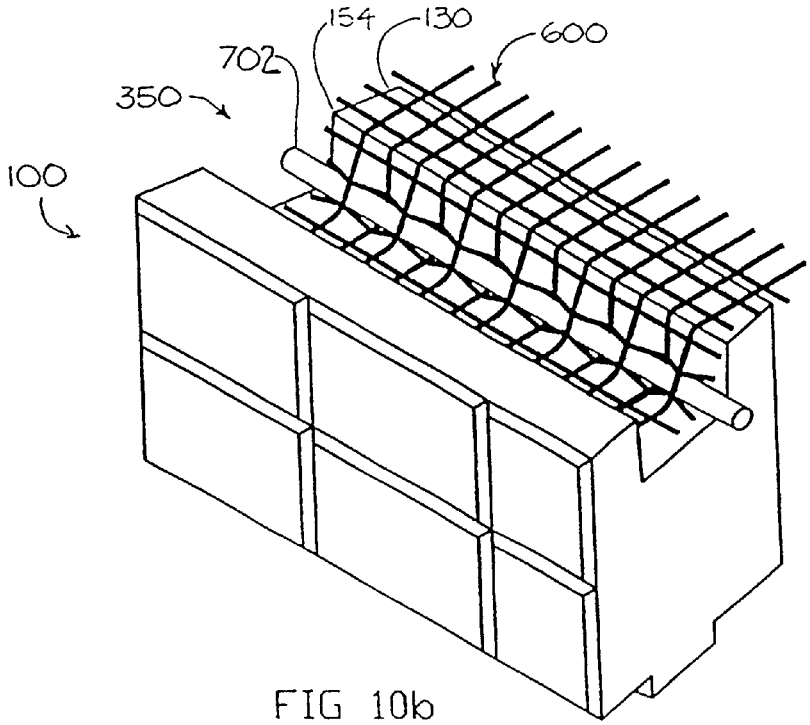
FIG. 10*b* is a perspective view of a block and the securing of the geogrid of FIG. 8

The geosynthetic sheet must be strong enough to resist loads and stiff enough to prevent excessive wall deflection. Examples of suitable geosynthetic sheets include geotextile and geogrid. Geotextile may be a closely woven fabric, like fibreglass, of the closeness sufficient to make industrial sacks. Geogrid 600 is a thin sheet of grid-like structure, resembling a net, which may be woven or constructed from a single sheet with perforations and is shown in FIGS. 9, 10*a* and 10*b*. For economy of description, geogrid 600 is shown and described but the applicable principles are equally applicable to geotextile. For economy of description, the principles about wedging geogrid 600 to block 101, shown in FIG. 9 and described below, are equally applicable to blocks 100, 300, 400 and 500 with minor modifications and will not be repeated.

After cores 150 are filled with filler for a course of blocks 101 and backfilled, as shown in FIG. 9, geogrid 600 may be secured by wedging it between adjacent upper and lower courses of blocks at their respective lower and upper surfaces. Geogrid 600 is placed as far forward as possible on the upper surface of blocks 101 of the lower course without exposing it on the face of the wall, and then laid behind the wall on the backfill. Another course of blocks is laid on top. Each upper block is then pulled or pushed forward so that lugs 215 and 220 of the then just laid upper course blocks 101 abut the front upper rims of cores 150 of blocks 101 below. Geogrid 600 is then pulled back and the portion thereof over the backfill is secured with stakes, gravel and soil 601. Lugs 215 and 220 depress and wedge the corresponding portion of geogrid 600 in associated cores 150 of the lower course blocks, as shown in FIG. 10*a*. The distortion of geogrid 600, with the filler, provides a good positive connection with good shear strength between blocks 101 and geogrid 600. Geogrid 600 is thereby anchored.

For blocks 100, 300, 400 and 500 which have channels, to provide even more anchoring of geogrid 600 to block 100, horizontal bar 702 is disposed in channel 350, approximate rear wall 130 and core rear upper rim 154, and geogrid 600 is wedged between bar 702 and rear wall 130, as shown in FIG. 10*b*. Intermittently, bar 702 is threaded through geogrid 600. Bar 702 may be of any suitable material of sufficient stiffness but it ideally can be made of stiff plastic which is bendable around corners. In practice, the core of block 100 is filled with filler to a suitable level (at about the level of the bottom of channel 350). Then the geogrid 600/bar 702 combination is placed (as described above), with the front of geogrid 600 resting on the top surface of the front wall (which is not shown in FIG. 10*b* for simplicity of illustration). Then channel 350 is filled (over the laid geogrid 600) with filler to create a good interlock. For channelled blocks 100, 300, 400 and 500, the technique of anchoring involving bar 702 is supplemented by the wedging technique described above (with block 101).

For channelled blocks 100, 300, 400 and 500, a wall is formed by a plurality of courses of blocks 100 having channels 350, wherein reinforcing rods 700 extend horizontally in channels 350 that run from block to block in a course, and reinforcing rods 701 extend downwardly the cores 150 of blocks 100, as shown in FIG. 8. For turning a 90° corner, blocks 400 or 401 with L-shaped channels 450 for bent reinforcing rods 700 may be used (not shown). Concrete is poured into the cores and channels, to provide secure interlock between courses.

Winged Block

Figure 16:
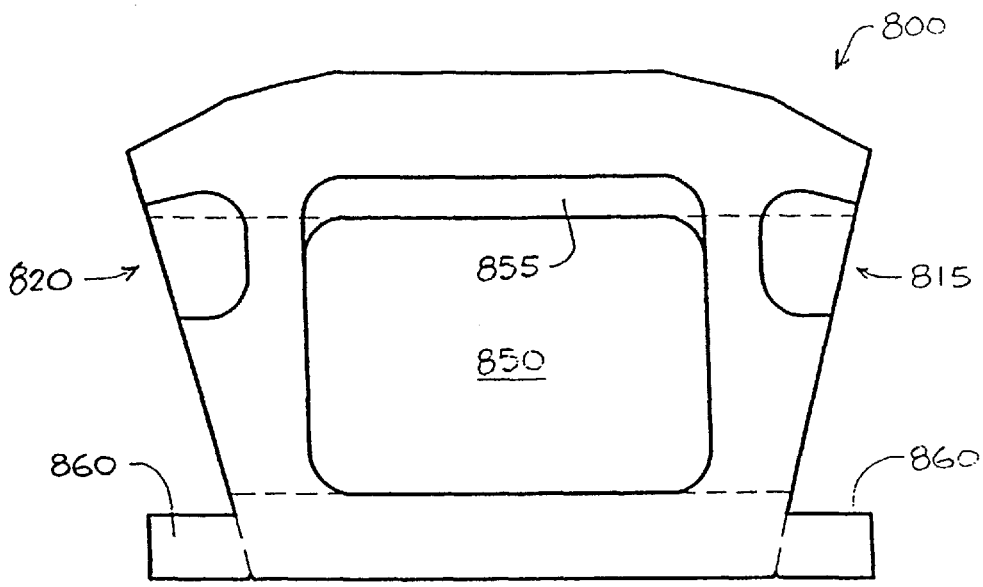
FIG. 16 is a bottom view of another block according to the invention
Figure 17:
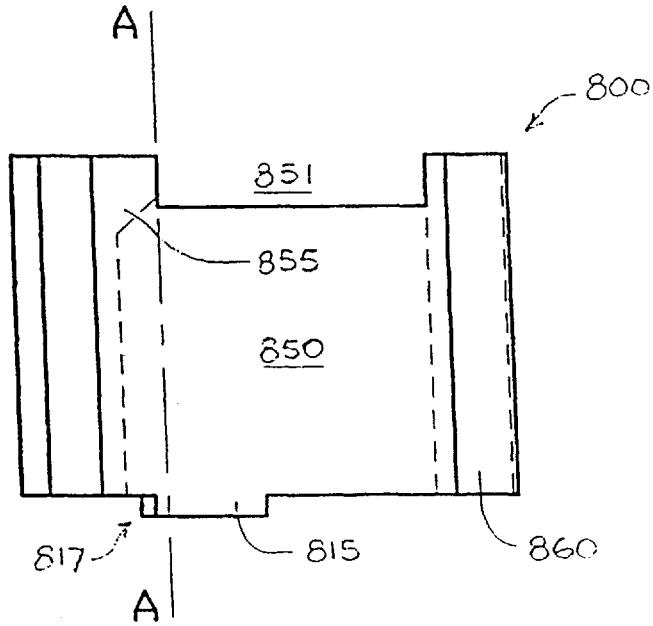
FIG. 17 is a side view of the block of FIG. 16
Figure 18:
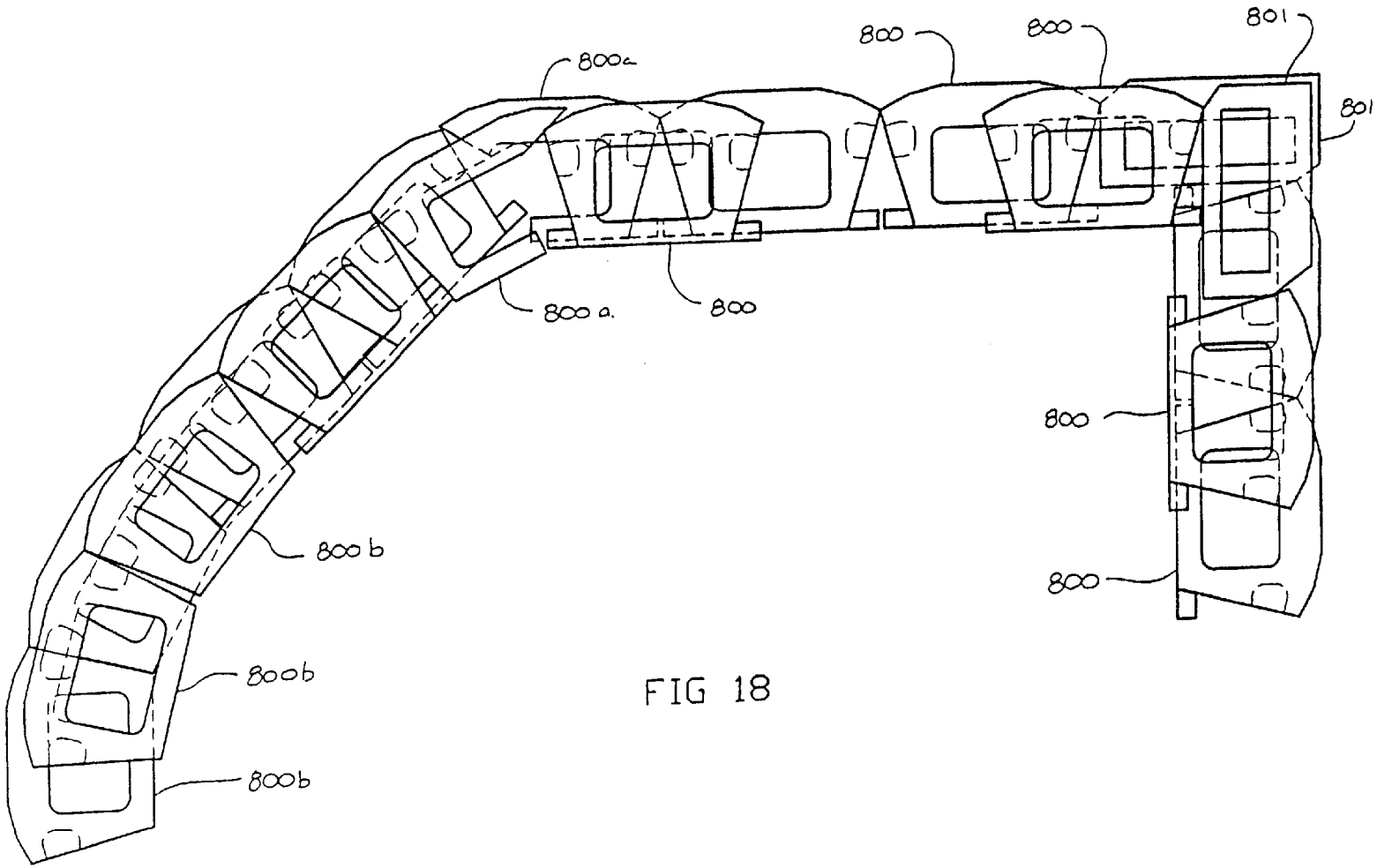
FIG. 18 is a top view of several courses of a wall portion constructed of blocks of FIGS. 16 and 17
Figure 19:
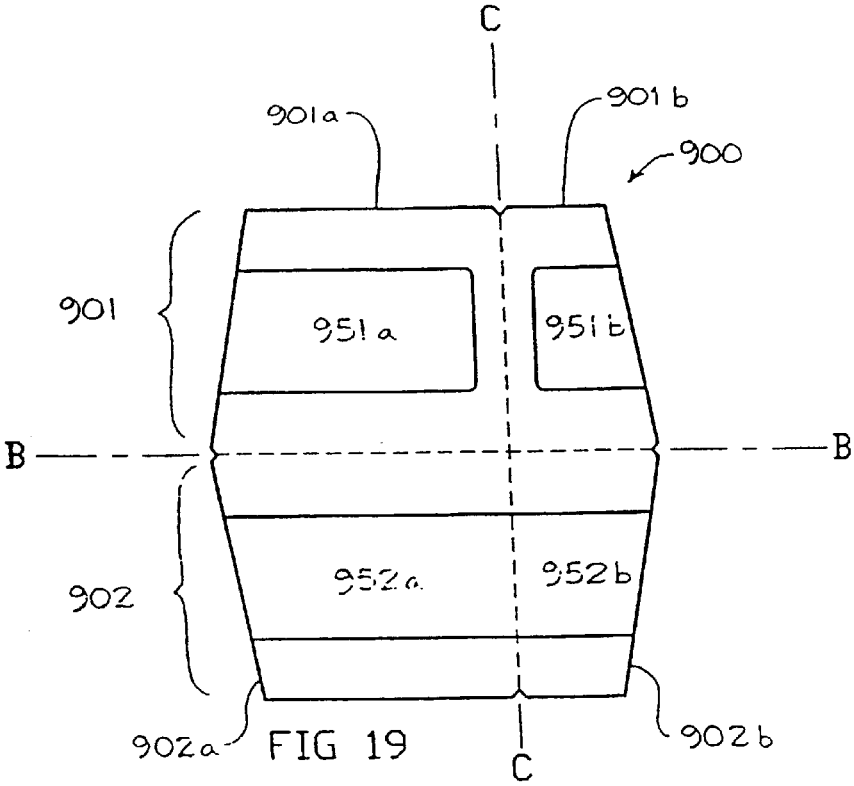
FIG. 19 is a top view of another block according to the invention

Block 800 (shown in FIGS. 16 and 17) is another block which is usually dimensioned smaller than blocks 100 or 300. Except for smaller dimensions, block 800 is similar to block 100 or 300. Lug 815, whose most forward rim of arcuate portion 817 may be aligned with the vertical plane defined by the front upper rim of core 850 (not shown) or slightly forward thereof (being the offset version, as shown in FIGS. 16, 17 and 18). Channel 851 provides the same function as channel 350 does for block 100, and like channel 350, is optional (if rods 700 or bars 702 are desired to be employed). For simplicity of illustration, channel 851 is not shown for blocks 800, 800*a* and 800*b* in FIG. 18.

Being smaller, block 800 is easily gripped, manipulated and laid by hand. There are a few differences with blocks 100 and 300. Core 850 has a lip 855 which allows the workman to easily grip the block. Wings 860 depend outwardly from each side walls and provide an additional anchor for the block in the backfill. Wings 860 may provide a width to the rear wall equal to that of the front wall, to facilitate the formation of a straight wall portion, as shown in FIG. 18.

Removal of parts of block 800 facilitate the construction of a convex wall portion. As shown in FIG. 18, a side wall of block 800 can be removed (block 800*a*) to construct a convex angular, non-90° corner; and also one or both wings 860 can be removed (block 800*b*) to create a convex curve portion. Removal of parts of block 800 is achieved by conventional methods like sawing and is facilitated by the presence of core 850. Cornerpiece 801 is used to complete the creation of a 90° convex corner. Cornerpiece 801 is approximately rectangular with a central core like other blocks and two of its diagonally opposed corners are profiled to accommodate the side walls of adjacent blocks 800 (i.e.

are profiled to fit between two blocks 800 transversely adjacent at a corner.

Modular Blocks

Another block 900 is shown in FIGS. 19–23. Block 900 is made from one mold by conventional means, and may be split by conventional guillotine techniques as follows.

There are notches, as shown, to define transverse lines B—B and C—C. Block 900 may be scored along lines B—B and C—C. For best effect of appearance, block 900 is not so scored but the lugs should be scored to facilitate the splitting of block 900 therethrough.

If block 900 is split along line B—B, then trapezoidal sub-block 901 and trapezoidal sub-block 902 result (which resemble blocks 100 and 300). Sub-block 901 can be further split along line C—C to produce two mini-blocks 901*a* and 901*b*. Similarly, sub-block 902 can be further split along line C—C to produce two miniblocks 902*a* and 902*b*. Thus block 900 can be split to produce a maximum of four mini-blocks, 901*a*, 901*b*, 902*a* and 902*b*.

Figure 20:
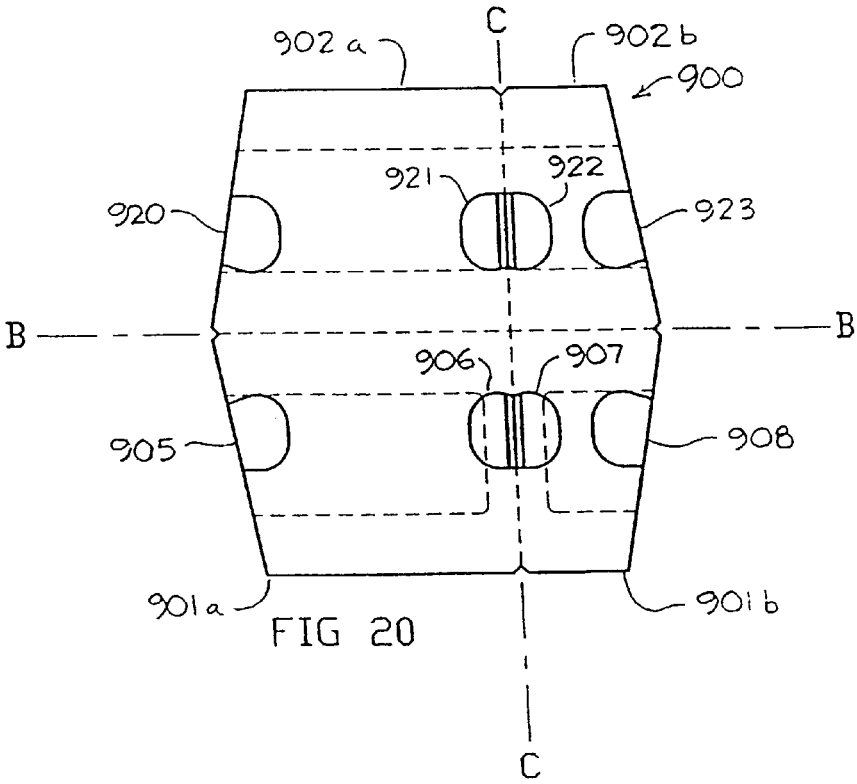
FIG. 20 is a bottom view of the block of FIG. 19

As shown in FIG. 20, mini-block 902*a* has lugs 920 and 921; mini-block 902*b* has lugs 922 and 923; and sub-block 902 has lugs 920 and 923. Similarly, mini-block 901*a* has lugs 905 and 906; mini-block 901*b* has lugs 907 and 908; and sub-block 901 has lugs 905 and 908.

Mini-blocks 901*a* and 901*b* have respectively blind channels 951*a* and 951*b*. Sub-block 901 has aligned blind channels 951*a* and 951*b* but has an obstruction therebetween. Mini-blocks 902*a* and 902*b* have respectively through channels 952*a* and 952*b*. Sub-block 902 has a through channel made of aligned channels 952*a* and 952*b*. The dimensions of the channels and lugs are a matter of choice guided by the design considerations described above in conjunction with blocks 100, but the lug of block 900 should generally be about half of the width of the channel.

Thus, from only one mold, it is possible to produce four different sub-blocks of three different sizes: one is a basic unit (sub-block 901 or sub-block 902) and two are corner pieces (mini-blocks 901*a* and 901*b*, or mini-blocks 902*a* and 902*b*). This is advantageous, as it allows splitting of a single block 900 on the installation site to produce the desired blocks as needed. It is often difficult to estimate accurately exactly how many blocks and their types are needed beforehand, especially with irregular landscape profiles. The conventional alternatives are to overestimate the required quantity and types of blocks and to transport all of them to the installation site (and thereby creating unnecessary waste or transportation costs), or to proceed with a guess of the required quantity and types of blocks and to obtain more blocks when it is apparent that they are needed (and thereby causing delay).

Figure 21:
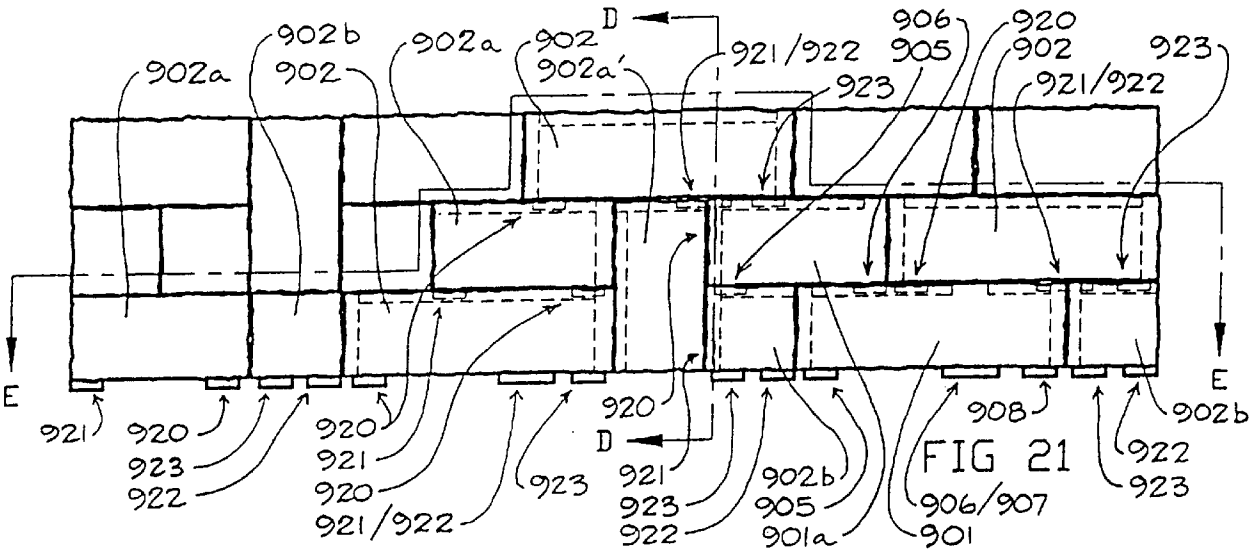
FIG. 21 is a front view of a wall portion constructed from the blocks of FIGS. 19 and 20
Figure 22:
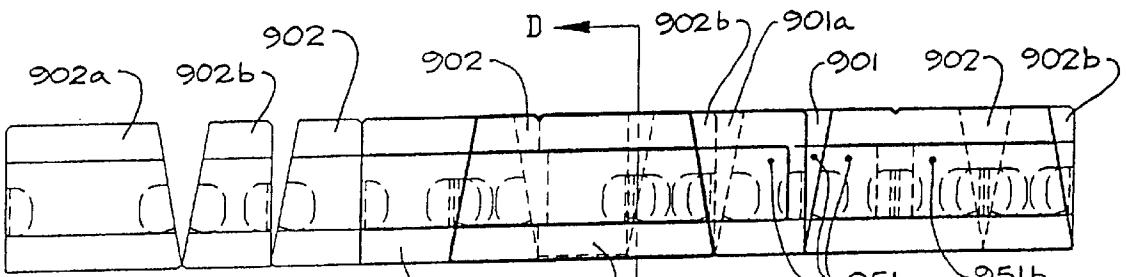
FIG. 22 is a top view taken along line E—E of the wall of FIG. 21

Sub-block 902 can be laid over sub-block 901 or sub-block 902 in half bond or near half bond (as shown in FIGS. 21 and 22). Sub-block 901 can be similarly placed over sub-block 901 or sub-block 902. There is no lateral limitation of sub-block 901 being laid over sub-block 902 blocks (because sub-block 902 has aligned channels 952*a* and 952*b* to permit maximum lateral freedom to dispose the lugs). But the interaction of sub-block 902 or sub-block 901 over a sub-block 901 is limited by the relative lengths of channels 951*a* and 951*b* of sub-block 901.

Block 900 is shown in a non-offset version (i.e. the front of the lugs are aligned in the same plane as the front rim of the channel) but offset versions of sub-block 901 and sub-block 902 are possible (offset versions as described for blocks 100 and 300, for example).

Figure 23:
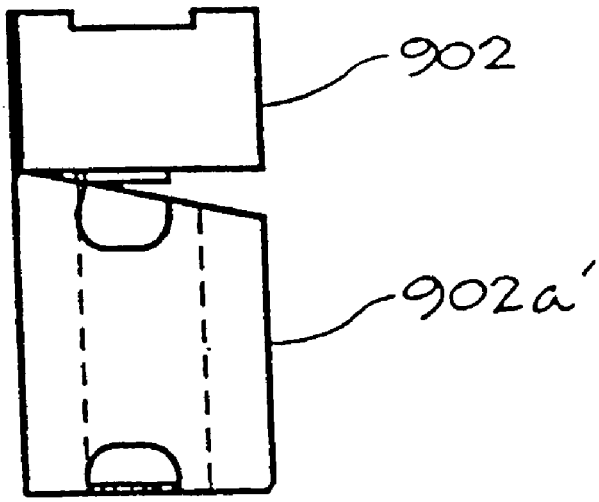
FIG. 23 is a side view of the wall of FIGS. 21 and 22 taken along line D—D

A wall made of sub-blocks 901 and 902, and mini-blocks 901*a*, 902*a*, and 902*b*, is shown in FIG. 21. Several courses of the wall along the line E—E of FIG. 21, are shown in top view in FIG. 22. FIG. 23 shows the wall taken alone line D—D of FIGS. 22 and 23.

Normally, a motarless wall consists of courses of elongate blocks which are each laid on their elongate sides horizontally, with the engagement means oriented vertically (like the blocks shown in FIG. 21, with one exception). According to this invention, a motarless wall can exceptionally include a block 902*a*' which is block 902*a* oriented vertically and resting on its straight side wall, as shown in FIGS. 21 to 23. This allows for improved appearance while not requiring a special block.

As shown in FIGS. 21 to 23, block 902*a*' is bracketed on top by sub-block 902; by mini-block 902*a* and sub-block 902 on the left, and by block 901*a* and block 902*b* on the right. Block 902*a*' is wedged from expulsion from the face of the wall (by the abutting of its lugs 920 and 921 against the sloped side wall of mini-block 902*b* and the sloped side wall of mini-block 901*a*). To allow for the placement of block like 902*a*', its lugs must face the sloped side wall of a neighboring block and not the straight side wall thereof (failing which, the lugs must be removed). The spanning of block 902*a*' by sub-block 902 is held in place by one lug of sub-block 902 disposed in the channel of block 901*a* on the right and the other lug is disposed in the channel of block 902*a* on the left.

The dimensions of block 900 and mini-blocks 901*a*, 901*b*, 902*a* and 902*b* may be set in an advantageous way. Both the length of the face of the front wall of sub-block 901 and the length of the face of the front wall of mini-block 901*a*, should be an integer multiple of the length of the face of the front wall of mini-block 901*b* (all lengths considered along line B—B). For example, sub-block 901 may be 15" long, 901*a* may be 10" long and 901*b* may be 5" long. The dimensions are defined by the locations of the notches and lines B—B and C—C defined thereby.

All blocks of this invention are of unitary construction, preferably made of high strength, high density concrete made by conventional wet-cast molding or machine precast molding.

The dimensions of block 100, 300 and 400 may be in the order of 2'×4'×2.' The channel is about 4" deep. The lugs are in the order of 6"×3"×1".

The dimensions of block 500 may be in the order of 2'×2'×2'. The lugs are in the order of 6"×3"×1".

The dimensions of block 800 are in the order of 1½'×1'×¾'. The core is in the order of 9¼"×6¼". The channel is about 1½" deep. The lugs are in the order 3"×2"×⅜" to ⅝" deep.

The channel in block 900 is about 1" deep and width of 4". Lugs are in the order of 2"×1½"×½".

It will be appreciated that the dimensions given are merely for purposes of illustration and are not limiting in any way. The specific dimensions given may be varied in practising this invention, depending on the specific application. For example, the core must not be excessively large relative to the block walls, for an application where the retained wall retains a parking lot which will suffer constant increases in stress and strain. Otherwise, wall thickness might be reduced to a point that could affect materially the load bearing capabilities of the block in a given application.

While the principles of the invention have now been made clear in illustrated embodiments, there will be obvious to those skilled in the art, many modifications of structure, arrangements, proportions, the elements, materials and components used in the practice of the invention, and otherwise, which are particularly adapted for specific environment and operation requirements without departing from those principles. The claims are therefore intended to cover and embrace such modifications within the limits only of the true spirit and scope of the invention.

What is claimed is:

1. A block comprising:

(a) an upper planar surface;

(b) a lower planar sub-surface;

wherein the block is scored to be split into (c) first longitudinal sub-block having an upper planar surface with a longitudinal through-channel and a lower planar surface having opposed outer lugs;

(d) second longitudinal sub-block having an upper planar surface with two opposed blind channels opening outwardly, and a lower planar surface having opposed outer lugs;

wherein said first sub-block is scored to be further split into:

(e) first mini-block having an upper planar surface with a longitudinal through-channel and a lower planar surface having opposed outer lugs;

(f) second mini-block having an upper planar surface with a longitudinal through-channel and a lower planar surface having opposed outer lugs.

2. A block comprising:

(a) an upper planar surface;

(b) a lower planar surface;

wherein the block is scored to be split into (c) first longitudinal sub-block having an upper planar surface with a longitudinal through-channel and a lower planar surface having opposed outer lugs;

(d) second longitudinal sub-block having an upper planar surface with two opposed blind channels opening outwardly, and a lower planar surface having opposed outer lugs;

wherein said second sub-block is scored to be further split into:

(e) first mini-block having an upper planar surface with one said longitudinal blind channel and a lower planar surface having opposed outer lugs;

(f) second mini-block having an upper planar surface with the other said longitudinal blind channel and a lower planar surface having opposed outer lugs.

* * * * *